US006105168A

United States Patent [19]

Hazen

[11] Patent Number: 6,105,168

[45] Date of Patent: Aug. 22, 2000

[54] BAG TYPE GARMENT FOR KEEPING A CHILD WARM

[76] Inventor: Natalie A. Hazen, 3143 Thomas, Berkley, Mich. 48072

[21] Appl. No.: 09/389,184

[22] Filed: Sep. 2, 1999

[51] Int. Cl.[7] ..... A41D 11/00

[52] U.S. Cl. ..... 2/69.5; 2/80; 2/75; 297/464; 5/413.2

[58] Field of Search ..... 2/69, 69.5, 80, 2/75; 297/464, 465; 5/413.2

[56] References Cited

U.S. PATENT DOCUMENTS

| | | | |
|---|---|---|---|
| D. 127,524 | 5/1941 | Segerman | D2/33 |
| D. 267,284 | 12/1982 | Andrews | D2/33 |
| 1,940,224 | 12/1933 | Munro | 5/343 |
| 4,241,458 | 12/1980 | Lesenese | 2/69.5 |
| 4,884,303 | 12/1989 | Scherer | 5/413 |
| 4,989,282 | 2/1991 | Goldstein | 5/413 |
| 5,852,827 | 12/1998 | Lear | 2/69.5 |
| 5,950,261 | 9/1999 | Hay et al. | 5/482 |
| 5,988,742 | 11/1999 | Stevens | 297/219.2 |

*Primary Examiner*—Bibhu Mohanty
*Attorney, Agent, or Firm*—Harness, Dickey & Pierce, PLC

[57] ABSTRACT

A bag-type garment that a child can be slipped into to keep the child's lower body and legs warm. The garment is made by stitching together an outer panel and an inner panel to form an enclosure having an open end. A batting or other material is positioned between the panels for added warmth. Velcro strips are provided along the open end to adjust the size of the opening to help retain the garment on the child. A loop is sewn to the garment to hang the garment. A connecting device is provided to connect the garment to a stroller bar or the like.

17 Claims, 2 Drawing Sheets

BAG TYPE GARMENT FOR KEEPING A CHILD WARM

BACKGROUND OF THE INVENTION

1. Field of the Invention

This invention relates generally to a garment for keeping a child warm and, more particularly, to a bag like garment that a small child is placed into to keep the child warm, and that has an adjustable opening and can be attached to a stroller.

2. Discussion of the Related Art

It is important for a child's health and well being to keep the child warm when he or she is exposed to cold weather. Cold weather protection for children is important during many types of outdoor activities, such as during sporting events, at outdoor fairs, parades, etc. Strollers are available that include a canopy that provides some protection to the child. However, the canopy attaches to the stroller and does not directly keep the child warm. It also inhibits a parent's interaction with the child.

Parents typically resort to various types of outer protective wear for keeping the child warm in cold weather conditions. For example, blankets are often used to keep a child warm in cooler temperatures. However, the child may tend to kick their legs which may result in the blanket being kicked off, thus exposing the child to the cold elements. If the child is using the blanket in a stroller, wagon or the like, and kicks the blanket off, it may fall to the ground and not be noticed for quite some time. Thus, there is the inconvenience of having to go back and locate the blanket. Also, the discarded blanket may become tangled in the stroller wheels, causing obvious problems. Additionally, more than one blanket is sometimes required. This creates additional items that the parent must carry and also creates more laundry if the blankets become soiled during use.

Snowsuits are another form of protective garment that parents sometimes use to keep their children warm in cold conditions. However, snow suits also suffer from a number of disadvantages, including being difficult and inconvenient to put on the child. Additionally, snowsuits may provide too much warmth causing the child to overheat. Further, the child may feel restricted in the snow suit, and therefore may put up a struggle or become difficult when being forced to wear them. Also, children grow quickly, and thus several snowsuits may need to be purchased over the child's early years. Because snowsuits are typically expensive, there is a significant cost incurred for this type of cold weather protection. Also, when a parent is carrying the child wearing the snowsuit, the child's pant legs may rise up exposing the child's skin to the cold elements.

What is needed is a protective garment for a child that is easy to use, low cost, provides suitable warmth and does not suffer from the various drawbacks and problems discussed above for the known child protective wear. It is therefore an object of the present invention to provide such a garment.

SUMMARY OF THE INVENTION

In accordance with the teachings of the present invention, a bag like garment is disclosed that a child can be slipped into to keep the child's lower body and legs warm. The garment is made by stitching together an outer panel and an inner panel to form an enclosure having an open end. A batting or other material is positioned between the panels for added warmth. Different materials can be used for the outer and inner panels for different weather conditions, including flannel, fleece, cotton, wool, etc. Likewise, different materials can be used for the batting, including down, thinsulate, etc. The various panels that make up the garment can come in different sizes for different sized or aged children.

The garment can include various features to make it more convenient to use. For example, cooperating hook and loop strips can be provided at the open end to adjust the size of the opening to help retain the garment on the child. Additionally, a loop can be sewn to the garment at a convenient location so that the garment can be hung for storage or to dry after laundering. Additionally, a zipper can be provided along the edges of the garment to unzip the garment, either partially or completely, to make the garment into a flat blanket or to expand the opening for ease of use. Additionally, connecting loops or the like can be sewn into the garment to allow it to be attached to a stroller support structure.

Additional objects, features and advantages of the present invention will become apparent from the following description and appended claims, taken in conjunction with the accompanying drawings.

BRIEF DESCRIPTION OF THE DRAWINGS

FIG. 2(*a*) is a broken-away view showing how the garment can be connected to a stroller support structure;

DETAILED DESCRIPTION OF THE PREFERRED EMBODIMENTS

The following discussion of the preferred embodiments directed to child protective wear is merely exemplary in nature, and is in no way intended to limit the invention or its applications or uses.

Figure 1:
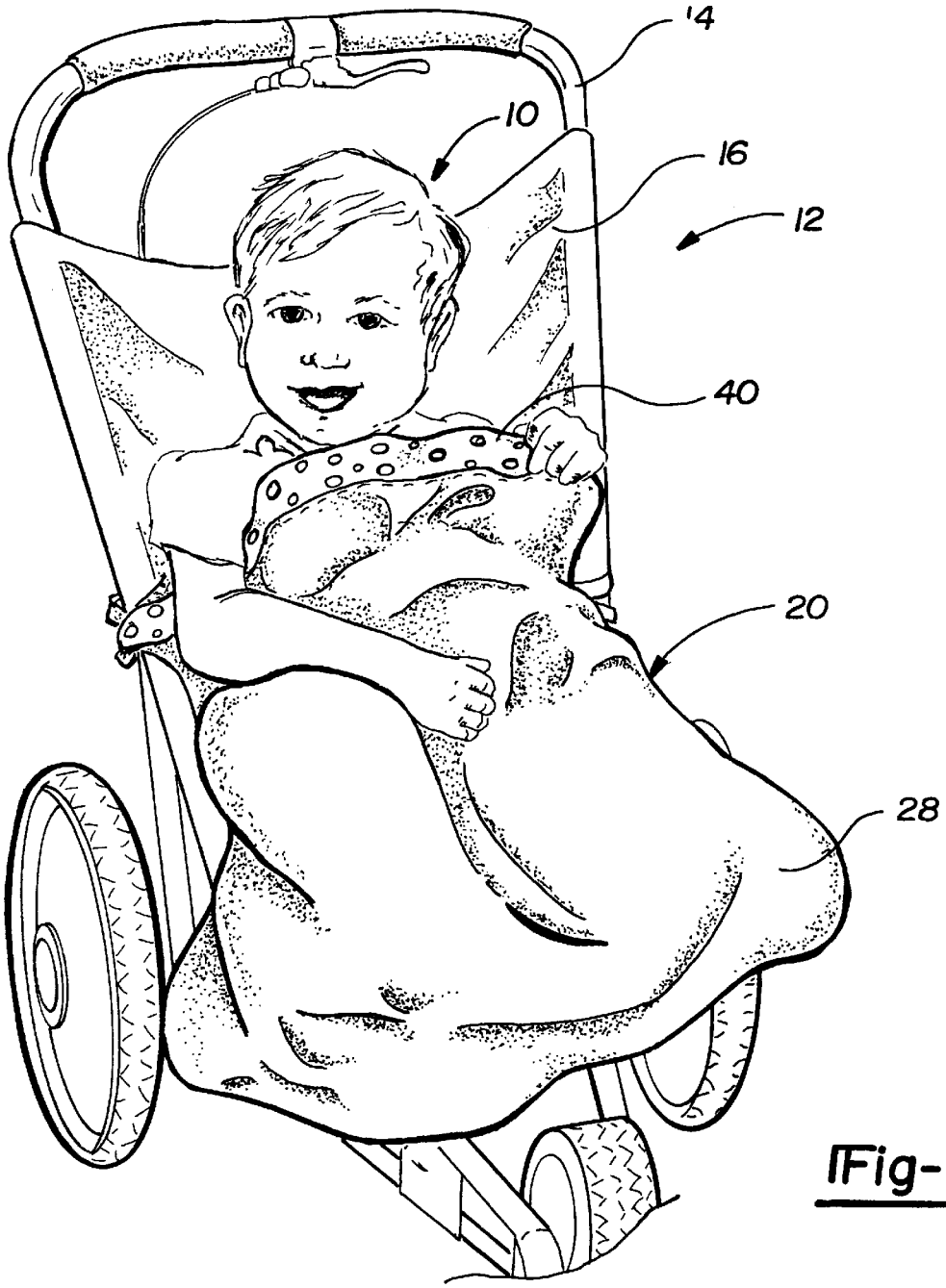
FIG. 1 shows a child in a stroller using a bag like garment, according to an embodiment of the present invention.
Figure 2:
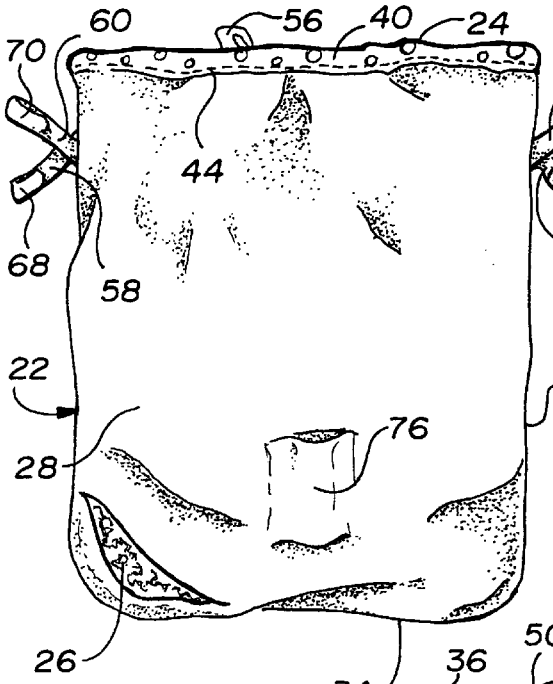
FIG. 2 is an outside back view of the garment shown in FIG. 1.
Figure 2A:
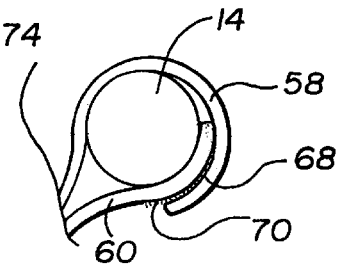
Figure 3:
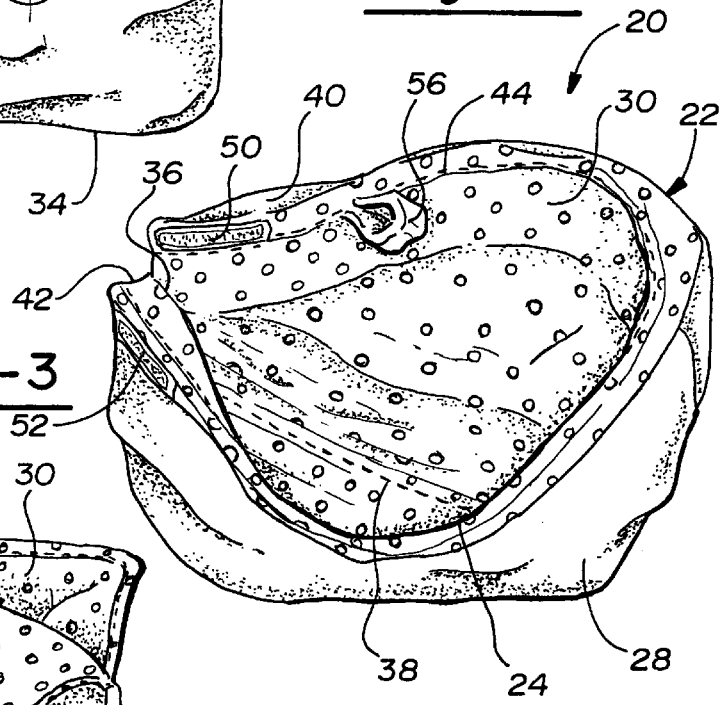
FIG. 3 is a top view of the garment shown in FIG. 1.

FIG. 1 shows a child 10 sitting in a stroller 12 and using a baby garment 20, according to an embodiment of the present invention. The stroller 12 is a runner's type stroller, but is intended to represent any baby stroller known in the art. The stroller 12 includes rods 14 defining the stroller structure. A seat 16 is attached to the rods 14 to provide a support on which the child 10 sits. FIG. 2 is an outside back view of the garment 20 and FIG. 3 is a top view of the garment 20 removed from the stroller 12.

The garment 20 defines a flat, rectangular-shaped enclosure 22 having an opening 24. The garment 20 is made from a number of layers of cloth that are sewn together in a certain manner to define the enclosure 22 to be closed on all sides except for the opening 24. Particularly, the garment 20 includes a single piece outer panel 28 and a single piece inner panel 30 sewn together to form a double wall. A batting 26 is positioned between the panels 28 and 30 for added warmth. In this embodiment, the outer panel 28 is formed by folding the single piece of material over itself and sewing along a side edge and an end edge opposite to the opening 24 to define seams 32 and 34. Likewise, the inner panel 30 is formed by folding the single piece of material over itself and sewing along a side edge and an end edge opposite to the opening 24 to define seams 36 and 38. The outer panel 28 and the inner panel 30 are then sewn together at select locations to define the double wall enclosure 22. A section 42 of the panels 28 and 30 is left open, as shown, to extend the size of the opening 24 along one side of the garment 20. An extended lip 40 of the inner panel 30 is folded over a top edge of the outer panel 28 at the opening 24, and a seam 44 is sewn along the lip 40 to hold it in place.

The outer and inner panels 28 and 30 can be made of any suitable material for different weather conditions. For example, the outer panel 28 can be made of flannel, cotton or wool, or a wind and/or rain resistant material. The inner panel 30 can be made of a different material, such as fleece, cotton or wool. The batting 26 can be any suitable material, such as thinsulate or down.

Cooperating loop and hook strips 50 and 52, such as Velcro strips, are stitched to the inside panel 30 proximate the opening 24, as shown. By selectively connecting the strips 50 and 52, the size of the opening 24 can be adjusted to accommodate children of different sizes and ages, or to make the garment 20 tighter or looser around the child for different weather conditions. Further, a cloth loop 56 is stitched to the inner panel 30 proximate the opening 24 to provide a structure to hang the garment 20 for storage or for drying after laundering.

Further, cooperating cloth strips 58 and 60 and cooperating cloth strips 62 and 64 are stitched to the outer layer 28 proximate opposite side edges of the garment 20. The strips 58 and 60 include cooperating loop and hook strips 68 and 70 and the strips 62 and 64 include cooperating loop and hook strips 72 and 74. The strips 58 and 60 and the strips 62 and 64 can be easily separated and connected together in a convenient manner to connect the garment 20 to a stroller pole, wagon support, or the like to attach the garment 20 to these structures. FIG. 2(*a*) shows the strips 58 and 60 attached to each other around the stroller rod 14.

Any suitable mechanism for attaching the garment 20 to the stroller or wagon can be used within the scope of the present invention. Alternately, a flap 76 can be sewn in the outer panel 28 to accommodate a stroller support bar or strap that can be slid through the flap 76 to secure the garment 20 to the stroller 12.

Figure 4:
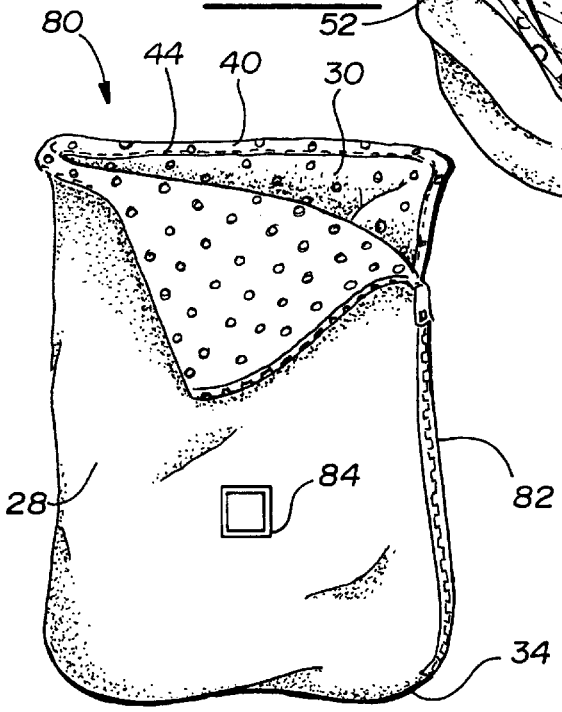
FIG. 4 is a front view of another bag like garment, according to another embodiment of the present invention.

FIG. 4 is perspective view of another garment 80 of the type discussed above, that includes a zipper 82 along one side edge where the seams 32 and 36 were previously provided. The zipper 82 can be stitched to both the inner and outer panels 28 and 30 to further extend the size of the opening 24 along a side of the garment 80. The zipper 82 can be extended around the bottom edge at seams 34 and 38 of the garment 80 in a sleeping bag like manner to allow the garment 80 to be unzipped into an entirely flat configuration to be used as a blanket.

Also, a hole 84 can be cut out of the inner panel 28 and the outer panel 30 on one side of the garment 80, and the inner and outer panels 28 and 30 can be sewn together around the edges of the hole 84. Likewise, a cooperating hole (not shown) can be cut out of the inner panel 28 and the outer panel 30 on the other side of the garment 80, and the inner and outer panels 28 and 30 can be sewn together around the edges of that hole so that both of the holes align with each other. Therefore, a strap or the like can be extended completely through the garment 80 to secure the garment 80 with the child therein to the stroller or other vehicle. In an alternate embodiment, the garment 80 could be used for a person in a wheelchair, where the holes 84 would accommodate security straps for the wheelchair, such as three interlocking straps. In this design, the child or person in the garment 80 would have his or her legs extending on both sides of the hole 84 and the support strap extending therethrough.

Various techniques can be used to sew the panels 28 and 30 together, and hold the batting 26 therebetween, within the scope of the invention. In one embodiment, the outer panel 28 is 23¼ inches wide and 31 inches long, the inner panel 30 is 25 inches wide and 29 inches long, and the batting is 24 inches wide and 29 inches long. The panel 28 is folded lengthwise, inside-out, and stitched using a zig-zag stitch along its respective length and width to form the seams 32 and 34. The panel 28 is stitched again along the seams 32 and 34 using a straight stitch. The panel 30 is also folded in the same manner and the seams 36 and 38 are sewn using the zig-zag and straight stitch. Both of the panels 28 and 30 are sewn so that three-quarters of an inch (¾") are left at the top of their lengths to form the section 42. Next, the panel 28 is laid on top of the panel 30 so that the bottom edges of the panels 28 and 30 are aligned. The panels 28 and 30 are then stitched together using a straight stitch, at a certain number of predetermined locations to anchor the panels 28 and 30 together.

Next, the sewn and anchored panels 28 and 30 are turned right side out, so that the outer panel 28 is on the outside and the inner panel 30 is on the inside. The next step is to take the batting 26 and place it between the panels 28 and 30 making sure to push the batting 26 all the way to the bottom edge. The lip portion of the panel 30 that sticks out at the top is folded over the panel 28 to form the lip 40. The lip 40 is then stitched to the outer panel 28 using a straight stitch. The strip 50 is then placed along the top border of the inner panel 30 and stitched in place using a straight stitch. Likewise, the strip 52 is placed along the top border opposite the strip 50 and stitched in place.

The loop 56 is then attached. The loop strip is folded lengthwise leaving a one-quarter inch (¼") fold down. A zig-zag stitch is used to sew down the middle of the loop 56. The loop strip is then formed into the loop 56 and the ends are sewn to the garment 20 next to the strip 50 using a straight stitch.

The garment 20 described above provides warmth to the child, and can be used during many modes of transportation, including strollers, sleds, wagons, bicycles and cars. It can be used for keeping the child warm at outdoor sporting events, such as football games and fairs. Further, a parent can carry their child around in the garment 20 while doing all sorts of outdoor activity. While using the garment 20, the child's legs and lower body stay covered and warm. The garment 20 is enclosed around the child, thus enabling him or her to move his or her legs about freely. The movement generates body heat and the garment 20 keeps in the heat. While allowing the child to move about, he or she won't feel as restricted and will most likely enjoy the time out more.

The foregoing discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A bag like garment for keeping a child warm, said garment comprising:

an inner panel made up of a cloth material;

an outer panel made of a cloth material and being sewn to the inner panel to define an enclosure being closed on all sides except for an open end, said inner and outer panels defining a space therebetween, said enclosure including opposing sides where the inner and outer panels on each side are cut and sewn to form openings through the sides of the enclosure that are aligned with each other to accept a support strap extending completely through the enclosure;

a batting positioned in the space between the inner and outer panels; and an end closing device sewn into the garment proximate the opening for adjusting the size of the opening.

2. The garment according to claim 1 wherein the end closing device includes cooperating strips of a hook and loop material.

3. The garment according to claim 1 further comprising a loop stitched to the garment for hanging the garment.

4. The garment according to claim 1 further comprising a zipper sewn into the garment at a side edge adjacent to the open end, said zipper allowing the garment to be opened and closed.

5. The garment according to claim 1 further comprising a pair of cloth strips that are sewn to the garment and are attachable together by cooperating loop and hook strips around a support bar on the vehicle.

6. The garment according to claim 1 further comprising a flap sewn in the outer panel that is configured to accept a vehicle support bar.

7. The garment according to claim 1 wherein the cloth material is selected from the group consisting of fleece, flannel, cotton and wool.

8. The garment according to claim 1 wherein the inner panel includes an edge portion folded over the open end and being sewn to the outer panel.

9. The garment according to claim 1 wherein the inner panel and the outer panel are each single piece sections that are sewn along their edges to form the enclosure, said inner panel being 25 inches wide and 29 inches long, and said outer panel being 23¼ inches wide and 31 inches long.

10. A cold weather bag like garment for a child, said garment comprising:

a single piece inner panel being sewn along its edges to form an enclosure having an open end;

a single piece outer panel being sewn along its edges to define an enclosure having an open end, said inner panel and outer panel being sewn together to form a double wall enclosure and defining a space therebetween, said inner panel including a lip portion folded over the open end and being stitched to the outer panel, said double wall enclosure including opposing sides where the inner and outer panels on each side are cut and sewn to form openings through the sides of the double wall enclosure that are aligned with each other to accept a support strap extending completely through the double wall enclosure;

a batting positioned within the space between the inner and outer panels;

a loop stitched to the garment for hanging the garment;

first and second strips of a hook and loop material sewn to the inner panel proximate the open end, and cooperating to adjust the size of the open end.

11. The garment according to claim 10 further comprising a pair of cloth strips that are attachable together by cooperating loop and hook strips around a support bar on a stroller.

12. The garment according to claim 10 further comprising a flap sewn in the outer panel.

13. The garment according to claim 12 further comprising a zipper sewn into the garment at a side adjacent to the open end, said zipper allowing the garment to be opened and closed.

14. A method of making a bag like garment, said method comprised of the steps of:

cutting a first panel made of a cloth material;

sewing the first panel along its edges to form a first bag-like enclosure having an open end;

cutting a second panel made of a cloth material;

stitching the second panel along its edges to form a second bag-like enclosure having an open end;

aligning the first sewn panel and the second sewn panel so that the open ends of the first bag-like enclosure and the open end of the second bag-like enclosure are aligned;

stitching the first bag-like enclosure to the second bag-like enclosure so that the open ends align to define a double-walled enclosure having a single open end;

positioning a batting material between the first and second panels;

cutting a hole through the first panel, the second panel and the batting material on one side of the garment and sewing the first panel to the second panel to form a first opening through the double-wall enclosure; and cutting a hole in the first panel, the second panel and the batting material on an opposite side of the garment and sewing the first panel to the second panel to form a second opening through the double-wall enclosure where the first opening and the second opening are aligned with each other to accept a support strap extending therethrough.

15. The method according to claim 14 further comprising the step of folding a border of the first panel over the open end of the second panel and stitching the border to the second panel.

16. The method according to claim 14 further comprising the step of stitching a loop to the second panel proximate the opening.

17. The method according to claim 14 further comprising the step of sewing a securing device to the first panel to connect the bag like garment to a stroller.

* * * * *